US005667590A

United States Patent [19]

Simons, Sr.

[11] Patent Number: 5,667,590

[45] Date of Patent: Sep. 16, 1997

[54] PAINTING MASK FOR USE WHEN PAINTING A RIM THAT IS SECURED TO A TIRE

[76] Inventor: Andrew E. Simons, Sr., 409 Governor Heyward Rd., Eastover, S.C. 29044

[21] Appl. No.: 638,726

[22] Filed: Apr. 29, 1996

[51] Int. Cl.[6] ..... B05C 21/00

[52] U.S. Cl. ..... 118/504; 118/505

[58] Field of Search ..... 118/504, 505, 118/213, 301, 406; 427/282

[56] References Cited

U.S. PATENT DOCUMENTS

| | | | |
|---|---|---|---|
| 2,716,391 | 8/1955 | Nonemaker et al. | 118/505 |
| 2,954,752 | 10/1960 | Hayward | 118/505 |
| 3,141,794 | 7/1964 | Horner | 118/505 |
| 3,192,896 | 7/1965 | Irving | 118/505 |
| 4,313,970 | 2/1982 | Jones et al. . | |
| 4,844,005 | 7/1989 | Filomeno . | |
| 5,178,913 | 1/1993 | Kusunoki et al. . | |
| 5,193,877 | 3/1993 | George, Jr. . | |
| 5,230,738 | 7/1993 | Wheeler . | |

*Primary Examiner*—Laura Edwards

[57] ABSTRACT

A painting mask for use when painting a tire rim that is secured to a tire including an elongated and generally rectangular strip having two free ends and with the strip bent in a generally circular shape to create a ring and with the ring having a diameter adjustably sized to fit around a peripheral extent of the tire rim and positionable against the tire secured therearound to confine painting operations; a first coupling mechanism for removably coupling the ends of the strip together and for allowing the diameter of the ring to be adjusted to fit around a peripheral extent of the tire rim; and a second coupling mechanism for removably coupling the ring to the tire.

1 Claim, 5 Drawing Sheets

PAINTING MASK FOR USE WHEN PAINTING A RIM THAT IS SECURED TO A TIRE

BACKGROUND OF THE INVENTION

1. Field of the Invention

The present invention relates to a painting mask for use when painting a rim that is secured to a tire and more particularly pertains to confining painting operations to only a tire rim and thereby preventing an associated tire from being painted with a painting mask.

2. Description of the Prior Art

The use of paint masking mechanisms is known in the prior art. More specifically, paint masking mechanisms heretofore devised and utilized for the purpose of preventing an undesired area from being painted are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,313,970 to Jones et al. discloses a method of masking a work piece for painting. U.S. Pat. No. 4,844,005 to Filmonemo discloses a paint spraying tire protection cover. U.S. Pat. No. 5,178,913 to Kusunoki et al. discloses a painting mask. U.S. Pat. No. 5,193,877 to George, Jr. discloses preformed masks for painting vehicles. U.S. Pat. No. 5,230,738 to Wheeler discloses a masking device.

While these devices fulfill their respective, particular objective and requirements, the aforementioned patents do not describe a painting mask that is readily secured to a tire rim and precludes painting of a tire that is secured about this tire rim.

In this respect, the painting mask for use when painting a rim that is secured to a tire according to the present invention substantially departs from the conventional concepts and designs of the prior art, and in doing so provides an apparatus primarily developed for the purpose of confining painting operations to only the rim and thereby preventing the tire from being painted.

Therefore, it can be appreciated that there exists a continuing need for new and improved painting mask for use when painting a rim that is secured to a tire which can be used for confining painting operations to only the rim and thereby preventing the tire from being painted. In this regard, the present invention substantially fulfills this need.

SUMMARY OF THE INVENTION

In the view of the foregoing disadvantages inherent in the known types of paint masking mechanisms now present in the prior art, the present invention provides an improved painting mask for use when painting a rim that is secured to a tire. As such, the general purpose of the present invention, which will be described subsequently in greater detail, is to provide a new and improved painting mask for use when painting a rim that is secured to a tire and method which has all the advantages of the prior art and none of the disadvantages.

To attain this, the present invention essentially comprises, in combination, an elongated and generally rectangular strip. The strip has a planar first surface, a planar second surface, a long planar edge perpendicularly interconnecting the surfaces on one side of the strip, a long beveled edge interconnecting the surfaces on the other side of the strip, and a pair of opposed short edges extended between the long edges. The strip further has a first linear arrangement of rectangular spaced apertures formed thereon at a location adjacent to the planar edge, a second linear arrangement of rectangular spaced apertures formed thereon at a location adjacent to the beveled edge, and a pair of free ends with one end having a pair of spaced and longitudinally positioned oblong slots formed thereon and the other end having a pair of fasteners coupled thereto. The strip is bent in a generally circular shape to thus create a ring with each fastener thereof disposed within one of the slots. The ring has a diameter sized to fit around a peripheral extent of the tire rim with either of the long edges positionable against the tire. The fasteners have a loosened orientation for allowing the diameter of the ring to be adjusted to fit snugly around a peripheral extent of the tire rim and a tightened orientation for setting the diameter of the ring. The ring serves to confine painting operations to only the tire rim. Lastly, a pair of J-shaped brackets is included. The brackets are removably coupled to and extended outwards from the ring for securing the ring to the tire. Each bracket is formed of a straight inboard component having an outboard end and an inboard end with a T-shaped cross-section removably secured within one of the apertures, an L-shaped intermediate component having an outboard end and an inboard end adjustably coupled to the outboard end of the inboard component with a fastener, and a L-shaped outboard component having an inboard end adjustably coupled to the outboard end of the intermediate component with a fastener.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved painting mask for use when painting a rim that is secured to a tire which has all the advantages of the prior art paint masking mechanisms and none of the disadvantages.

It is another object of the present invention to provide a new and improved painting mask for use when painting a rim that is secured to a tire which may be easily and efficiently manufactured and marketed.

It is a further object of the present invention to provide a new and improved painting mask for use when painting a rim that is secured to a tire which is of durable and reliable construction.

An even further object of the present invention is to provide a new and improved painting mask for use when painting a rim that is secured to a tire which is susceptible of a low cost of manufacture with regard to both materials and labor, and which accordingly is then susceptible of low prices of sale to the consuming public, thereby making such a painting mask for use when painting a rim that is secured to a tire economically available to the buying public.

Still yet another object of the present invention is to provide a new and improved painting mask for use when painting a rim that is secured to a tire which provides in the apparatuses and methods of the prior art some of the advantages thereof, while simultaneously overcoming some of the disadvantages normally associated therewith.

Even still another object of the present invention is to provide a new and improved painting mask for use when painting a rim that is secured to a tire for confining painting operations to only the rim and thereby preventing the tire from being painted.

Lastly, it is an object of the present invention to provide a new and improved painting mask for use when painting a rim that is secured to a tire comprising an elongated and generally rectangular strip having two free ends, the strip bent in a generally circular shape to create a ring and with the ring having a diameter adjustably sized to fit around a peripheral extent of the tire rim and positionable against the tire secured therearound to confine painting operations; first coupling means for removably coupling the ends of the strip together and for allowing the diameter of the ring to be adjusted to fit around a peripheral extent of the tire rim; and second coupling means for removably coupling the ring to the tire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
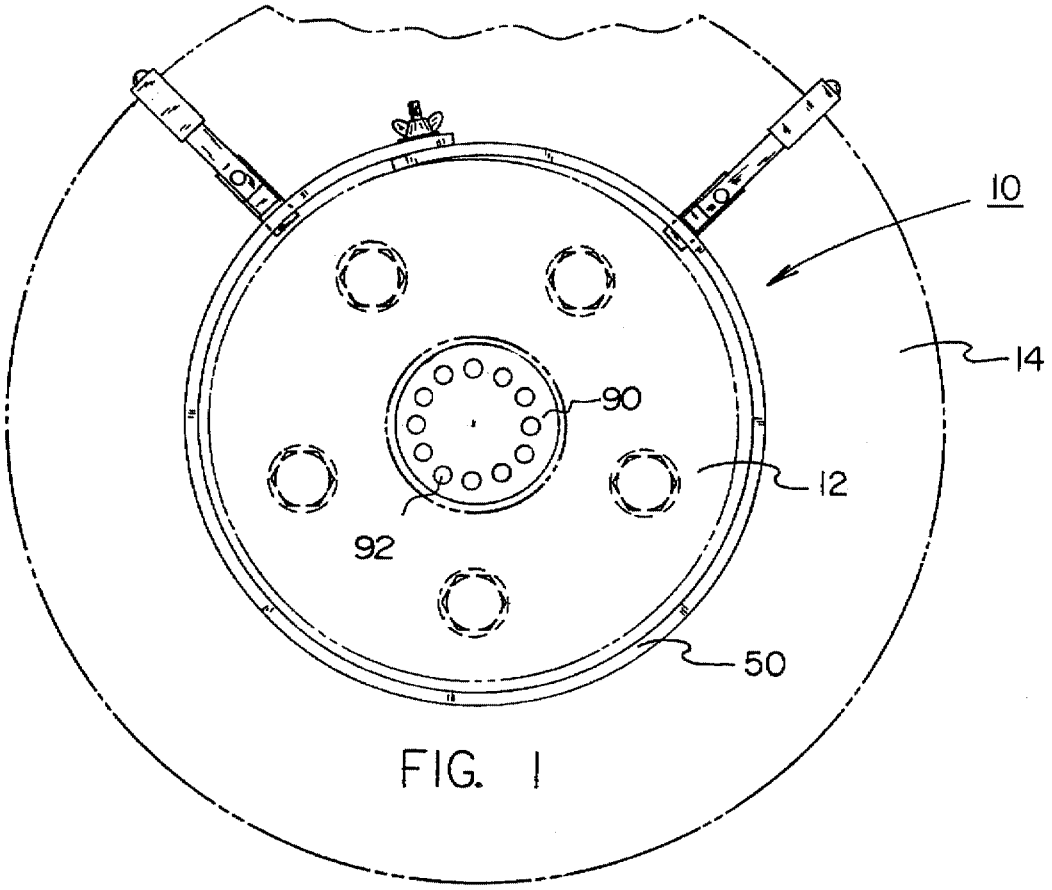
FIG. 1 is a plan view of the preferred embodiment constructed in accordance with the principles of the present invention.
Figure 2:
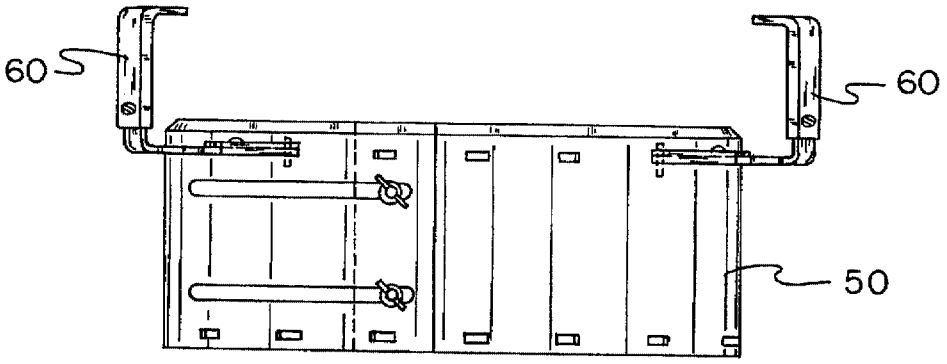
FIG. 2 is a side elevational view of the present invention.
Figure 3:
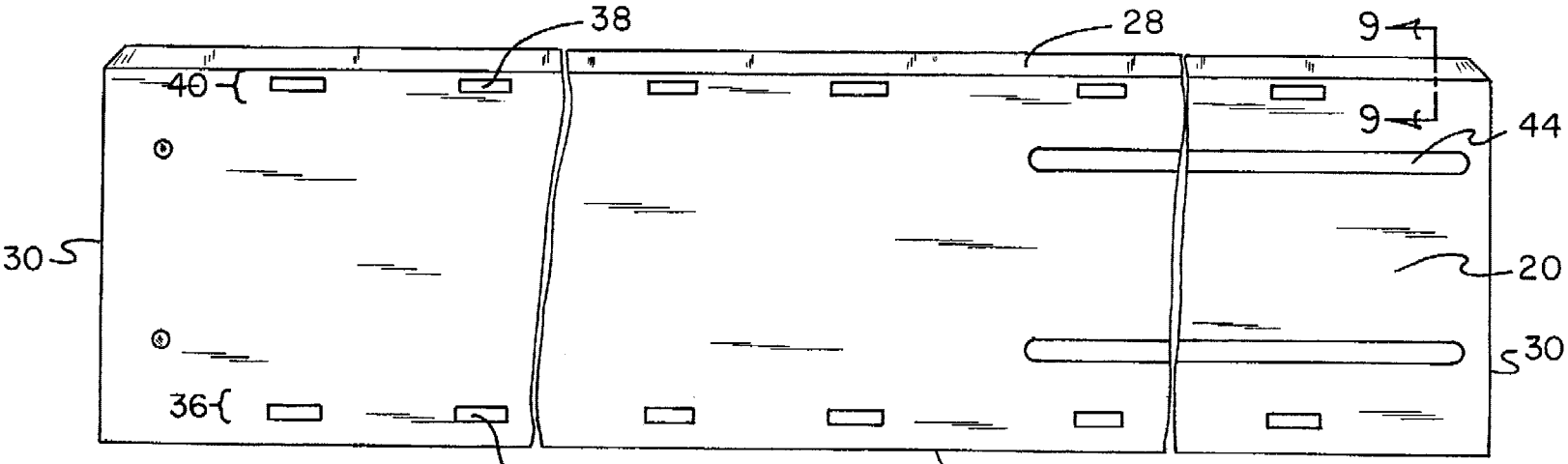
FIG. 3 is another side elevational view of the present invention with its brackets removed.
Figure 9:
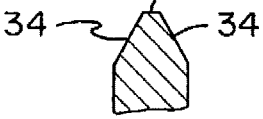
FIG. 9 is a top plan view of the optional hub of the present invention.
Figure 4:
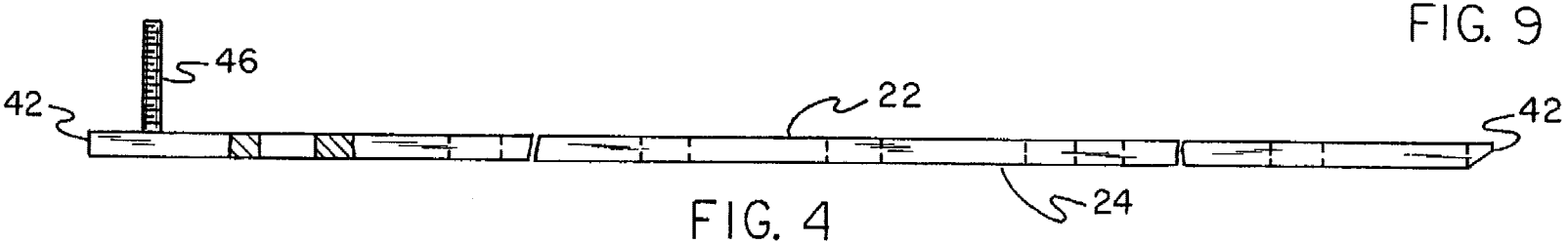
FIG. 4 is a side view of a portion of the strip of the present invention.
Figure 5:
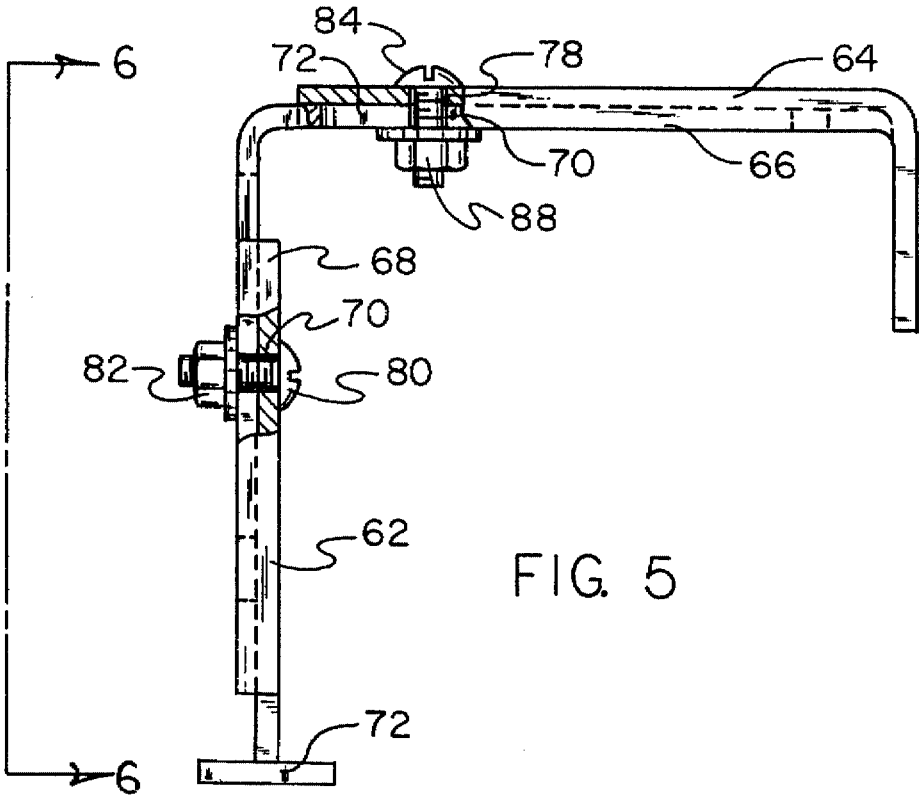
FIG. 5 is an enlarged view of one of the brackets the present invention.
Figure 6:
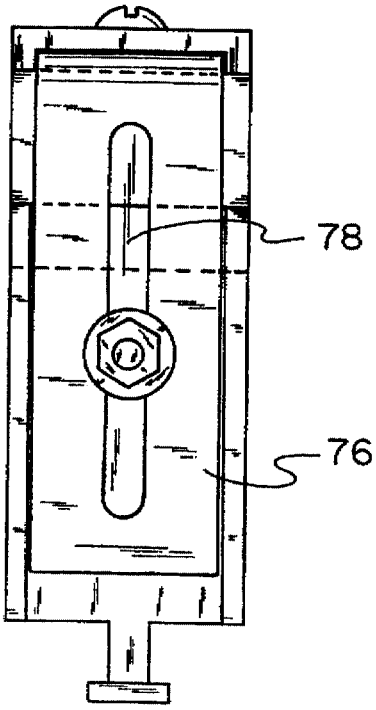
FIG. 6 is a view of one of the brackets of the present invention taken along the line 6—6 of FIG. 5.
Figure 7:
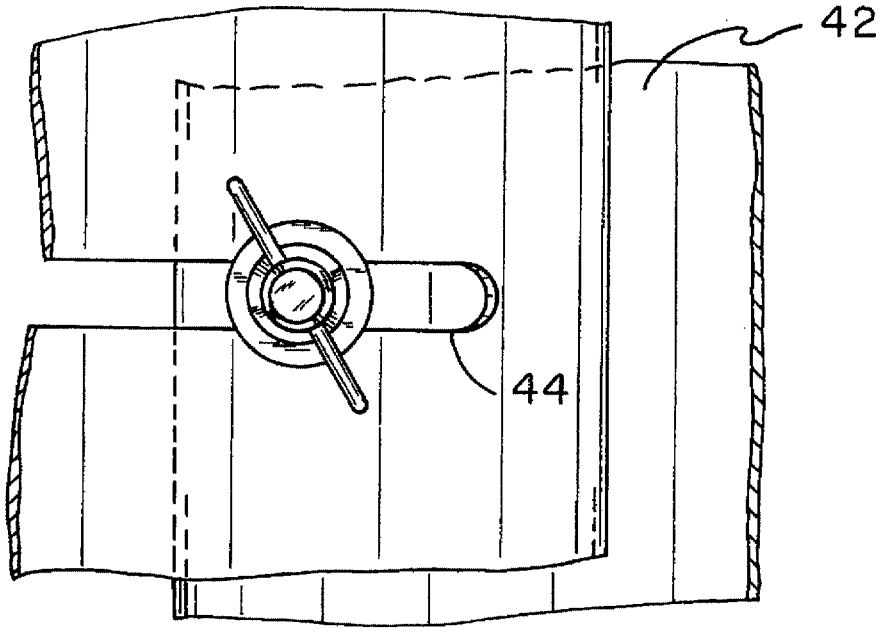
FIG. 7 is an enlarged fragmentary view of the coupling of the ends of the strip to form a ring.
Figure 8:
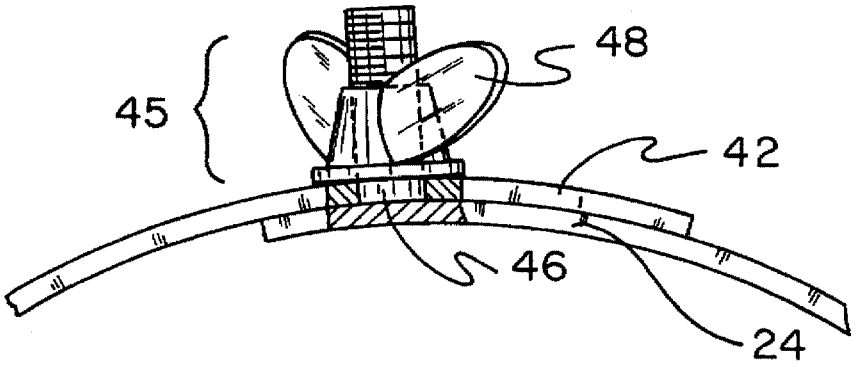
FIG. 8 is another view of the coupling of the strips as previously shown in FIG. 7.
Figure 9:
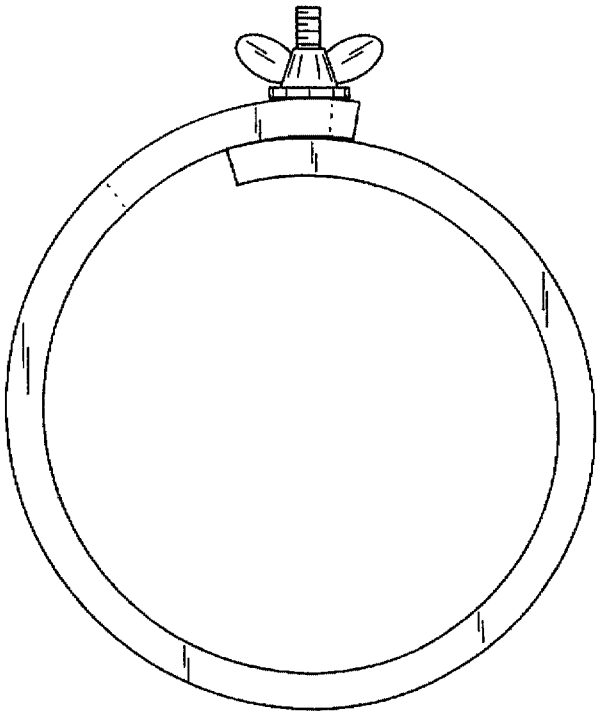
Figure 10:
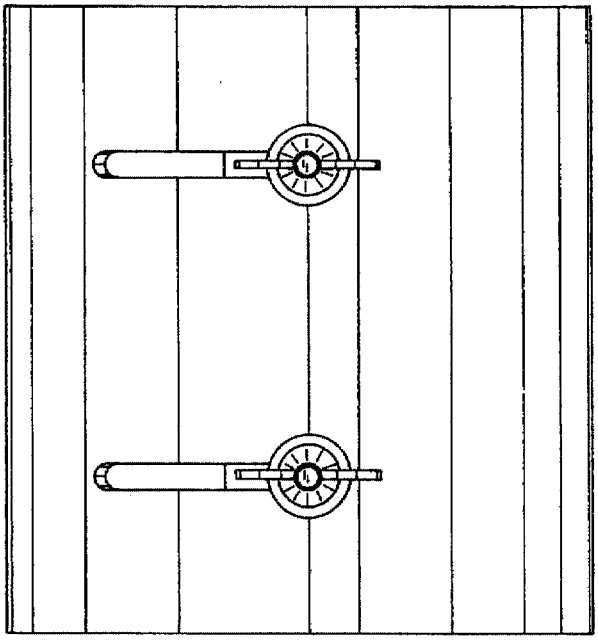
FIG. 10 is a side elevation view of the optional hub as seen in FIG. 9.

With reference now to the drawings, and in particular, to FIG. 1 thereof, the preferred embodiment of the new and improved painting mask for use when painting a rim that is secured to a tire embodying the principles and concepts of the present invention and generally designated by the reference number 10 will be described.

The preferred embodiment of the present invention comprises a plurality of components. In their broadest context, such components include a strip and a pair of brackets. Such components are individually configured and correlated with respect to each other to provide a structure that is used when painting a tire rim 12 when this tire rim is secured to a tire 14. The mask thereby confines painting operations to only the tire rim and thus prevents the tire from being painted.

Specifically, the present invention includes a strip 20. The strip is elongated and generally rectangular in structure. The strip has a planar first surface 22 and a planar second surface 24. A long straight planar edge 26 perpendicularly interconnects the surfaces on one side of the strip. A long straight beveled edge 28 interconnects the surfaces on the other side of the strip. A pair of opposed short edges 30 are extended between the long edges. The strip has a length that is greater than about 8 inches to fit around a conventional vehicle tire rim, and a width as measured perpendicularly between the long edges of about 8 inches. This width allows the strip to effectively block overspray or overbrush of paint onto a tire. The beveled long edge is formed of a blunt edge portion 32 with a pair of angled edge portions 34 extended therefrom. The bevel has a width of about ½ inch as measured perpendicularly from the blunt edge portion to an adjacent planar portion of the strip. The beveled edge thus allows the strip to be positioned tightly against a tire rim that has a flanged outer periphery. The non-beveled edge allows the strip to be positioned tightly against a tire rim with no flanged outer periphery. The strip further includes a first linear arrangement 36 of rectangular and spaced apertures 38 formed thereon. The first arrangement 36 is positioned at a location adjacent to the planar edge 26. In addition, a second linear arrangement 40 of rectangular and spaced apertures are formed on the strip at a location adjacent to the beveled edge 28. The first arrangement is positioned in parallel with the second arrangement. The apertures 38 of both the first arrangement and second arrangement are of equal size. Each aperture of the first arrangement is symmetrically offset from an aperture of the second arrangement. The strip also includes a pair of free ends 42. One free end has a pair of spaced, longitudinally positioned, parallel, and oblong slots 44 formed thereon. The other end has a pair of fasteners 45 coupled thereto. Each fastener is formed of a threaded post 46 coupled to and extended perpendicularly upwards from the first surface. Each post 46 has a wing nut 48 threadedly securable thereto.

The strip is bent in a generally circular shape to create a ring 50. Each post of each fastener 45 is disposed within one of the slots 44 and then secured with the corresponding wing nut 48. The ring has a diameter that is adjustably sized to fit around a peripheral extent of the tire rim 12 with either of the long edges 26, 28 positionable against the tire. The edge that is positionable in contact with the tire is the one that best conforms with the outer extent of the rim and the surface of the tire itself. The fasteners 45 have a loosened orientation for permitting movement of the posts within the slots, thereby allowing the diameter of the ring 50 to be adjusted to fit snugly around a peripheral extent of the tire rim. The fasteners also have a tightened orientation for setting the diameter of the ring. When the diameter of the ring is set snugly about the tire rim, the ring serves to confine painting operations to only the tire rim. Thus, the rim serves as a mask for preventing paint from being applied to the tire.

A pair of J-shaped rigid spaced brackets 60 are also provided. The brackets are removably coupled to and extended radially outwards from the ring 50. The brackets are used for securing the ring to the tire 14. Each bracket is formed of a straight inboard component 62, an L-shaped outboard component 64, and an L-shaped intermediate component 66 therebetween. The inboard component 62 has an outboard end 68 with a through hole 70 formed thereon and an inboard end 72 with a generally T-shaped cross-section. The inboard end 72 is removably secured within one of the apertures 38 of the ring 50. The L-shaped intermediate component has an outboard end 72 with a through hole 70 formed thereon and an inboard end 76 with a slot 78 formed thereon. The inboard end 76 is adjustably coupled to the outboard end 62 of the inboard component with a fastener. The fastener is formed of a bolt 80 extended within the through hole 70 and the slot 78 and is secured with a nut 82. The L-shaped outboard component 64 has an inboard end with a slot 78 formed thereon. The inboard end is adjustably coupled to the outboard end 72 of the intermediate component with a fastener. The fastener is formed of a bolt 84 extended within the slot 78 and through hole 70 and is secured with a nut 88. With this configuration, the J-shaped brackets can be adjusted to conform with the height and thickness of a tire 14 for holding the ring in the desired position around the tire rim.

An optional mask formed of a rigid planar plate (not shown) secured with threaded bolts (not shown) can also be used with the aforementioned components. The bolts are secured to the hub or axle center of a wheel of a vehicle. The mask prevents paint from being applied to the heavy duty truck hub or axle centers.

The present invention is an adjustable ring that is placed against a wall of a tire to protect it when the tire rim of the tire is being painted. The ring of the present invention is made of plastic or metal and has a large opening to which the tire rim of a wheel is exposed. The ring is formed of a strip with curved slots on one end and tapped through holes on the other end for receipt of fasteners such as wing screws. The present invention is held in place by two brackets which fit over an outer peripheral extent of a tire. Preferably, the present invention is used for painting rims of wheels on industrial equipment. Typically, the rims of the wheels on such industrial equipment are at least 26 inches in diameter. The strip of present invention can be fashioned in a size larger than this diameter and can then be adjusted down to fit this and other sizes. By flexing the present invention, its size can be adjusted and clamped in place by tightening the wing screws on the ends. The inside diameter of the ring rests against the tire rim, and the brackets over the tire support the weight of the ring and hold it in place. The present invention protects a tire from being painted. For concentric sectioned or two-color rims, a second instance of the present invention adjusted to an appropriate size can be simultaneously used.

The present invention offers an inexpensive way to mask the rims of tires for painting. The present invention can be used over and over again, thereby making it valuable for use on fleets of trucks. It properly masks a rim for painting and thus prevents overspraying when a paint spray delivery mechanism is used or overbrushing when a paint brush is used. The brackets of the present invention can be adjusted to accommodate varying tire heights and widths.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A painting mask for use when painting a tire rim that is secured to a tire for confining painting operations to only the tire rim and thereby preventing the tire from being painted comprising, in combination:

an elongated and generally rectangular strip having a planar first surface, a planar second surface, a long planar edge perpendicularly interconnecting the surfaces on one side of the strip, a long beveled edge interconnecting the surfaces on the other side of the strip, and a pair of opposed short edges extended between the long edges, the strip further having a first linear arrangement of rectangular spaced apertures formed thereon at a location adjacent to the planar edge, a second linear arrangement of rectangular spaced apertures formed thereon at a location adjacent to the beveled edge, and a pair of free ends with one end having a pair of spaced and longitudinally positioned oblong slots formed thereon and the other end having a pair of fasteners coupled thereto, the strip being bendable in a generally circular shape to thus create a ring with each fastener disposed within one of the slots, the ring having a diameter sized to fit around a peripheral extent of the tire rim with either of the long edges positionable against the tire secured therearound with the fasteners having a loosened orientation for allowing the diameter of the ring to be adjusted to fit snugly around a peripheral extent of the tire rim and a tightened orientation for setting the diameter of the ring and with the ring serving to confine painting operations to only the tire rim; and a pair of J-shaped brackets removably coupled to and extended outwards from the ring for securing the ring to the tire, each bracket formed of a straight inboard component having an outboard end and an inboard end with a T-shaped cross-section removably secured within one of the apertures, a L-shaped intermediate component having an outboard end and an inboard end adjustably coupled to the outboard end of the inboard component with a fastener, and a L-shaped outboard component having an inboard end adjustably coupled to the outboard end of the intermediate component with a fastener.

* * * * *